US010792733B2

(12) United States Patent
Mueller et al.

(10) Patent No.: US 10,792,733 B2
(45) Date of Patent: Oct. 6, 2020

(54) METHOD FOR PRODUCING A SWASHPLATE

(71) Applicant: Miba Sinter Austria GmbH, Laakirchen (AT)

(72) Inventors: Alexander Mueller, Altmuenster (AT); Jose Correa Neto, Campinas-Sp (BR)

(73) Assignee: Miba Sinter Austria GmbH, Laakirchen (AT)

( * ) Notice: Subject to any disclaimer, the term of this patent is extended or adjusted under 35 U.S.C. 154(b) by 82 days.

(21) Appl. No.: 15/825,394

(22) Filed: Nov. 29, 2017

(65) Prior Publication Data

US 2018/0154449 A1 Jun. 7, 2018

(30) Foreign Application Priority Data

Dec. 6, 2016 (AT) ..... A 51107/2016

(51) Int. Cl.

| | |
|---|---|
| ***F04B 27/08*** | (2006.01) |
| ***B22F 5/00*** | (2006.01) |
| ***B22F 3/24*** | (2006.01) |
| ***B22F 7/04*** | (2006.01) |
| ***F04B 27/10*** | (2006.01) |

(Continued)

(52) U.S. Cl.

CPC ..... *B22F 7/04* (2013.01); *B22F 5/008* (2013.01); *C22C 38/04* (2013.01); *C22C 38/08* (2013.01); *C22C 38/12* (2013.01); *C22C 38/16* (2013.01); *F04B 27/086* (2013.01); *F04B 27/0878* (2013.01); *F04B 27/0886* (2013.01); *F04B 27/0891* (2013.01); *F04B 27/0895* (2013.01); *F04B 27/1036* (2013.01); *B22F 2003/242* (2013.01); *B22F 2301/35* (2013.01); *B22F 2998/10* (2013.01); *C22C 33/0257* (2013.01); *C23C 8/22* (2013.01); *C23C 8/26* (2013.01); *C23C 8/32* (2013.01); *C23C 8/38* (2013.01); *C23C 8/50* (2013.01); *C23C 8/56* (2013.01);

(Continued)

(58) Field of Classification Search

None

See application file for complete search history.

(56) References Cited

U.S. PATENT DOCUMENTS 3,720,504 A * 3/1973 Frehn ..... C22C 29/067 419/15
3,991,658 A * 11/1976 Bobier ..... F04B 1/20 91/505

(Continued)

FOREIGN PATENT DOCUMENTS

CN 1530544 A 9/2004
CN 101294557 A 10/2008

(Continued)

OTHER PUBLICATIONS

JP H02181077 A machine translation to English from espacenet. (Year: 1990).*

(Continued)

*Primary Examiner* — Abiy Teka
*Assistant Examiner* — Michael Quandt
(74) *Attorney, Agent, or Firm* — Collard & Roe, P.C.

(57) ABSTRACT

The invention relates to a swashplate (5) for a swashplate compressor (1) comprising a main swashplate body (8), which is made from a sintering material, and to a method for producing the swashplate (5).

7 Claims, 1 Drawing Sheet

(51) Int. Cl.

| | |
|---|---|
| ***C22C 38/16*** | (2006.01) |
| ***C22C 38/08*** | (2006.01) |
| ***C22C 38/12*** | (2006.01) |
| ***C22C 38/04*** | (2006.01) |
| *C23C 8/56* | (2006.01) |
| *C22C 33/02* | (2006.01) |
| *C23C 8/50* | (2006.01) |
| *C23C 8/32* | (2006.01) |
| *C23C 8/38* | (2006.01) |
| *C23C 28/04* | (2006.01) |
| *C23C 8/22* | (2006.01) |
| *C23C 8/26* | (2006.01) |

(52) U.S. Cl.
CPC ..... *C23C 28/046* (2013.01); *F05B 2230/22* (2013.01); *F05C 2201/0475* (2013.01)

(56) References Cited

U.S. PATENT DOCUMENTS

| | | | | |
|---|---|---|---|---|
| 4,583,921 | A | 4/1986 | Wolff et al. | |
| 6,139,296 | A * | 10/2000 | Okajima | C23C 8/38 148/222 |
| 6,666,128 | B2 | 12/2003 | Sugiura et al. | |
| 6,829,980 | B2 | 12/2004 | Sugiura et al. | |
| 6,860,255 | B2 * | 3/2005 | Yamaguchi | C23C 8/80 123/495 |
| 7,108,829 | B2 | 9/2006 | Fukuhara et al. | |
| 8,939,644 | B2 | 1/2015 | Akizuki et al. | |
| 2018/0236553 | A1 * | 8/2018 | Ito | C23C 8/50 |

FOREIGN PATENT DOCUMENTS

| | | | | | |
|---|---|---|---|---|---|
| CN | 101469687 | A | | 7/2009 | |
| CN | 101868622 | A | | 10/2010 | |
| CN | 102974989 | A | | 3/2013 | |
| CN | 103170632 | A | | 6/2013 | |
| CN | 103470475 | A | | 12/2013 | |
| EP | 0 149 219 | A2 | | 7/1985 | |
| EP | 1 236 897 | A2 | | 9/2002 | |
| EP | 1 251 274 | A2 | | 10/2002 | |
| JP | 59051173 | A | * | 3/1984 | F04B 1/2078 |
| JP | 60077903 | A | * | 5/1985 | |
| JP | 61276949 | A | * | 12/1986 | |
| JP | 02181077 | A | * | 7/1990 | |
| JP | 11280648 | A | * | 10/1999 | |
| JP | 3045569 | B2 | | 5/2000 | |

OTHER PUBLICATIONS

JP S60077903 A machine translation to English from espacenet. (Year: 1985).*

JP S59051173 A machine translation to English from espacenet. (Year: 1984).*

JP S61276949 A machine translation to English from espacenet. (Year: 1986).*

JP H11280648 A machine translation to English from espacenet. (Year: 1999).*

* cited by examiner

METHOD FOR PRODUCING A SWASHPLATE

CROSS REFERENCE TO RELATED APPLICATIONS

Applicant claims priority under 35 U.S.C. § 119 of Austrian Application No. A 51107/2016 filed on Dec. 6, 2016, the disclosure of which is incorporated by reference.

The invention relates to a method for producing a swashplate for a swashplate compressor, wherein the swashplate comprises a swashplate body.

Furthermore, the invention relates to a swashplate for a swashplate compressor comprising a swashplate body, and a swashplate compressor comprising a swashplate.

Swashplate compressors, also known as swashplate compactors, are known from the prior art. This type of compressor is often used in the air conditioning systems of vehicles. Said compressors also comprise a swashplate, which is mounted by sliding into so-called shoes. Usually, the swashplates are made from a cast material, for example bronze, the final form being produced by machining, in particular by turning. For said shoes often high-alloyed steels with a relatively high degree of hardness are used. The shoes are also partly described as being produced from sintered materials.

Particularly in cases of insufficient lubrication or with no lubrication, relatively high degrees of wear occur on the swashplate in the mounting area of the shoes.

The underlying objective of the present invention is to produce a swashplate more simply. In particular, a secondary objective of the invention is to improve the wearing resistance of a swashplate.

The objective of the invention is achieved by the aforementioned method, in which the main swashplate body is made from a sintering powder or a plurality of sintering powders according to a powder-metallurgical method.

Furthermore, the objective is achieved by the aforementioned swashplate, in which the swashplate body is made from a sintered material, and by the aforementioned swashplate compressor, in which the swashplate is designed according to the invention.

It is an advantage in this case that despite the geometrically simple structure of the swashplate, it is possible to reduce costs by making the latter from a sintered material. The swashplate can be produced in a near net-shape or net-shape quality. The porousness and/or the open-pores of the sintered swashplate are an advantage, as the pores facilitate the binding of further layers which may be arranged on the surface of the swashplate at least in some areas. In addition, said pores can store lubricant, whereby it is possible to effectively avoid having completely dry conditions for mounting the swashplate in the swashplate shoes.

According to one embodiment variant of the method or the swashplate it is possible for the main swashplate body to be made from an iron-based sintering powder or consist of the latter. It is thus possible to give the swashplate a greater degree of hardness, whereby its wearing resistance can be improved.

To further improve said effects, according to one embodiment variant an alloy can be used as an iron-based sintering powder, which contains between 0.1 wt. % and 0.9 wt. % C, between 0 wt. % and 5.0 wt. % Ni, between 0.04 wt. % and 2 wt. % Mo, between 0.05 wt. % and 1 wt. % Mn and between 0 wt. % and 3 wt. % copper, the remainder being formed by iron.

Preferably, the main swashplate body is surface-hardened after sintering, to improve its wearing resistance further.

It is particularly preferable to nitride or carbonitride the surface of the sintered main swashplate body for hardening, wherein according to a further embodiment variant the main swashplate body is plasma-nitrided or plasma-carbonitrided on the surface. In this way it is possible not only to improve the wearing resistance itself, particularly if the aforementioned iron-based material is used, but it is also possible to introduce residual compressive stresses into the swashplate, thereby improving the fatigue strength.

According to a further embodiment variant it is possible to deposit or apply an additional layer onto the nitrided or carbonitrided surface of the main swashplate body. In this way the tribological properties of the swashplate can be influenced positively, whereby the resistance of the swashplate to frictional welding can be improved even in dry conditions, such as at the beginning of the operation for example.

Preferably, an anti-friction lacquer layer or a PVD layer or a DLC layer can be deposited as an additional surface layer or the additional surface layer is an anti-friction lacquer layer, a PVD-layer or a DLC layer, whereby the tribological properties of the swashplate can be improved further in that the frictional resistance of the surface of the swashplate can be reduced.

For a better understanding of the invention the latter is explained in more detail with reference to the following figures.

In a simplified, schematic representation:

Figure 1:
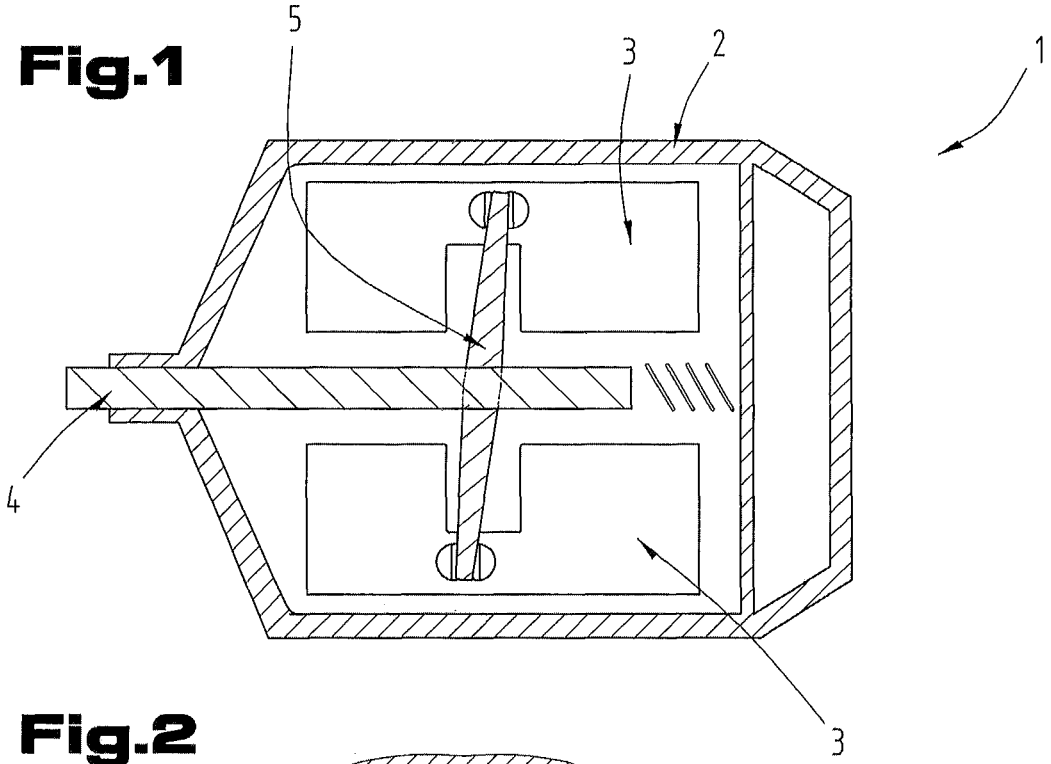
FIG. 1 shows a cross-section of a swashplate compressor.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position.

FIG. 1 shows a swashplate compressor 1 (also referred to as a swashplate compactor) in a very schematic simplified form. The swashplate compressor 1 comprises a housing 2, at least one piston 3 and/or cylinder, a drive axle 4 and a swashplate 5. By means of the drive axle 4 a rotational movement is introduced into the swashplate 5. The rotational movement is thereby transferred into an axially oscillating piston movement, whereby it is possible to build up the pressure in the pressure medium.

As the principle structure of a swashplate compressor 1 and its operating principle have already been described in detail in the relevant prior art, reference is made to the latter to avoid repetition here.

Figure 2:
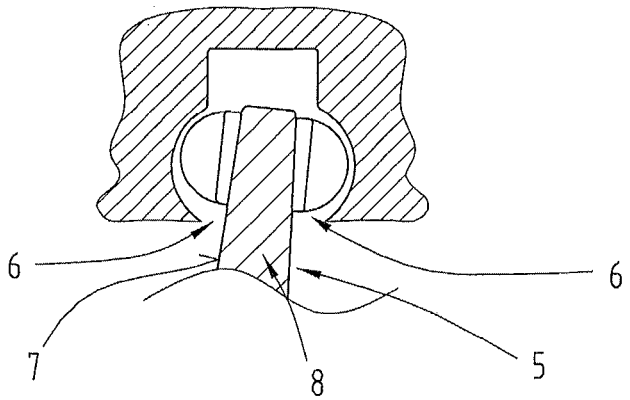
FIG. 2 shows a detail of the swashplate compressor according to FIG. 1 in the region of the bearing of the swashplate in the swashplate bearing shoes.

FIG. 2 shows in detail the sliding bearing of the swashplate 5 in cross-section. The swashplate 5 is mounted in swashplate shoes 6. The swashplate shoes 6 form a sliding bearing and are preferably made of steel. Surfaces 7 of the swashplate 5 slide on said swashplate shoes 6. Therefore, particularly in this area the swashplate 5 is subjected to relatively high mechanical stress, so that an improvement of the wearing resistance of the swashplate 5 would be an advantage.

To improve the wearing resistance thus a main swashplate body of the swashplate 5 is produced from one or more sintering powders according to a powder-metallurgical method, so that the main swashplate body 8 is made from a sintering material or is a sintered component.

The method for producing the main swashplate body 8 comprises at least the steps of powder mixing, compressing the powder to form a green compact and sintering the green compact.

During the powder mixing a powder mixture is made from metal powders. If necessary however an already pre-alloyed metal powder or a hybrid alloy powder can be used. A hybrid alloy powder contains in this case only a portion of the alloy elements, whereas a prealloyed powder contains all of the alloy elements. Therefore, when using a hybrid alloy powder the missing alloy elements have to be mixed in.

Various additional additives such as binding agents, e.g. resins, silanes, oils, polymers or adhesives, or pressing additives, e.g. waxes, stearates, silanes, amides, polymers can be added to the powder mixture.

The proportion of additives in the whole powder mixture can be up to a maximum of 5 wt. %, in particular up to a maximum of 4 wt. %.

In principle any suitable powder can be used as the metal powder or metal powder mixture. In a preferred embodiment variant of the method or swashplate 5 however an iron-based sintering powder is used to produce the main swashplate body 8.

In particular, an alloy is used as an iron-based sintering powder which contains between 0.1 wt. % and 0.9 wt. % C (graphite), between 0 wt. % and 5.0 wt. % Ni, between 0.04 wt. % and 2 wt. % Mo, between 0.05 wt. % and 1 wt. % Mn and between 0 wt. % and 3 wt. % copper, the remainder being formed by iron. For example, an alloy is used as an iron-based sintering powder which contains between 0.4 wt. % and 0.7 wt. % C (graphite), between 1.5 wt. % and 2.0 wt. % Ni, between 0.04 wt. % and 0.6 wt. % Mo, between 0.05 wt. % and 0.3 wt. % Mn and between 1.3 wt. % and 1.7 wt. % copper, the remainder being formed by iron. The proportions of alloy elements are related to the iron-based sintering powder itself and not to the mixture with the possibly used additives.

The powder or the powder mixture is then compressed to form a green compact. The compression can be performed for example by means of a coaxial pressing method. By means of the compression the main swashplate body 8 is given its shape so that preferably the changes in form and configuration taking place during subsequent method steps are already taken into consideration during the production of the pressing tools.

The compression is preferably performed up to a density of the green compact of more than 6.5 g/cm$^3$, in particular more than 6.8 g/cm$^3$. Pressing forces of 600 to 1200 MPa are used, depending on the bulk density and theoretical density of the powder mixtures.

Instead of the coaxial pressing method also other pressing methods can be used which are usual in sintering technology, thus e.g. also isostatic pressing methods, etc.

After the appropriate release of the green compacts the latter are sintered in one or multiple stages. For this a reducing atmosphere can be used in the sintering furnace. For example a nitrogen-hydrogen mixture can be used with a proportion of up to 30 vol. % hydrogen. Preferably, mixtures are used with a hydrogen content of between 5 vol. % and 30 vol. %, although it is also possible to use mixtures with less than 5 wt. %. Optionally also a carburizing gas (endogas, methane, propane, etc.) can be used or added to the nitrogen-hydrogen mixture. The proportion can be selected from a range with a lower limit of 0.01 vol. % and an upper limit of 2.55 vol. %, relative to the whole mixture.

The sintering can be performed at a temperature of between 900° C. and 1350° C. for a period of between 10 minutes and 65 minutes at this temperature. Afterwards the sintered main swashplate bodies 8 are cooled.

If the sintering is performed in several stages the temperatures of the pre-sintering can be between 740° C. and 1050° C., and the sintering period can be between 10 minutes and 2 hours.

During the presintering also organic binding agents and lubricants are burned out.

During the presintering there is only a limited amount of sintering of the powder grains, which results in the formation of a weaker sintered compound.

At a presintering temperature of below 1100° C. it is also possible that the graphite only diffuses incompletely into the iron matrix material.

The second sintering stage can be performed at a temperature of between 1100° C. and 1350° C. The sintered molded parts can be kept at this temperature for between 10 minutes and 65 minutes.

Afterwards the finally sintered main swashplate bodies 8 are cooled.

It is possible that the green compact, the provisionally sintered part or the finished sintered part are subjected to mechanical processing known from the prior art. For example, bevels etc. can be made or formed on the main swashplate body 8.

It is also possible to subsequently compress and/or calibrate the presintered or finally sintered swashplate main bodies 8, in case the swashplate main bodies 8 have not already been produced with a near net-shape or net-shape quality.

Preferably, a surface 9 of the main swashplate body 8 is produced to have a degree of porousness, i.e. in that the main swashplate body 8 at least in the area of the surface 9 or at least in the areas of said surface 9 has a density of between 6.5 g/cm$^3$ and 7.8 g/cm$^3$.

The pores can have a maximum size of between 0.1 μm and 2.5 μm, as viewed in a plan view of the surface 9.

As explained above, a better bonding of additional layers is made possible by means of the pores, provided that the latter are provided on the main swashplate body 8.

For this reason it is also preferable that if the subsequent compression and/or calibration of the sintered main swashplate bodies 8 needs to be performed the latter is not performed to the degree that the pores on the surface are fully closed and a sealed surface is formed.

Afterwards, by means of suitable cooling units at the furnace outlet cooling occurs at a cooling speed of between 2 K/s and 16 K/s from the sintering heat below the Mf and hardening takes place. By means of the abrupt cooling and if necessary carburizing media during the sintering martensitic hardening structures are formed and the residual stresses are set, which have an advantageous effect on the mechanical properties, in particular the fatigue properties.

After the sintering process in addition to the hardening the parts can also be tempered by the sintering heat.

According to one embodiment variant of the method it is possible for the main swashplate body 8 to be hardened after sintering.

The hardening can be performed for example by rapidly cooling from the sintering heat, for example at a cooling speed of more than 2° C./s.

Preferably, the hardening is also performed by nitriding or carbonitriding the sintered main swashplate body 8, for example gas-nitriding or gas-carbonitriding. Particularly preferably, the hardening is performed by means of plasma-nitriding or plasma-carbonitriding.

For plasma-nitriding or plasma-nitrocarburization the main swashplate body 8 is placed into a treatment chamber in which at least one nitrogen source and if necessary at least one carbon source is provided. The plasma processing of the main swashplate body 8 can be performed with the following parameters. The main swashplate body 8 is preferably cleaned in plasma prior to the heat treatment, if necessary after the preceding removal of oils and fats in a cleaning device. Preferably, the cleaning is performed by means of sputtering.

The temperature of the plasma-nitriding or plasma-carbonitriding can be selected from a range of 350° C. and 600° C., in particular selected from a range of 400° C. and 550° C. If necessary, the temperature can vary over the duration of the method, in each case the temperature being in the said temperature range.

The plasmanitriding or plasmacarbonitriding can be performed within 1 hour to 60 hours.

As the atmosphere in the plasma chamber hydrogen or nitrogen or argon or a mixture of the latter can be used, for example a mixture of hydrogen and nitrogen. The ratio of the volume share of hydrogen and nitrogen in this mixture can be selected from a range of 100:1 to 1:100. If necessary the volume share of hydrogen and nitrogen can vary over the duration of the method, in which the ratios are in any case within the said ranges. Additional process gases can be provided, the total amount in the atmosphere being a maximum of 30 vol. %.

The electric voltage between the electrodes is selected from a range of 300 V to 800 V, in particular from a range of 450 V to 700 V. It is thus also possible for the voltage to be varied during the plasma treatment of the main swashplate body 8.

Here at least two separate electrodes can be used and also the main swashplate body 8 itself can be connected as an electrode.

The pressure in the treatment chamber during the plasma treatment of the main swashplate body 8 can be selected from a range of 0.1 mbar to 10 mbar, in particular from a range of 2 mbar to 7 mbar.

Figure 3:
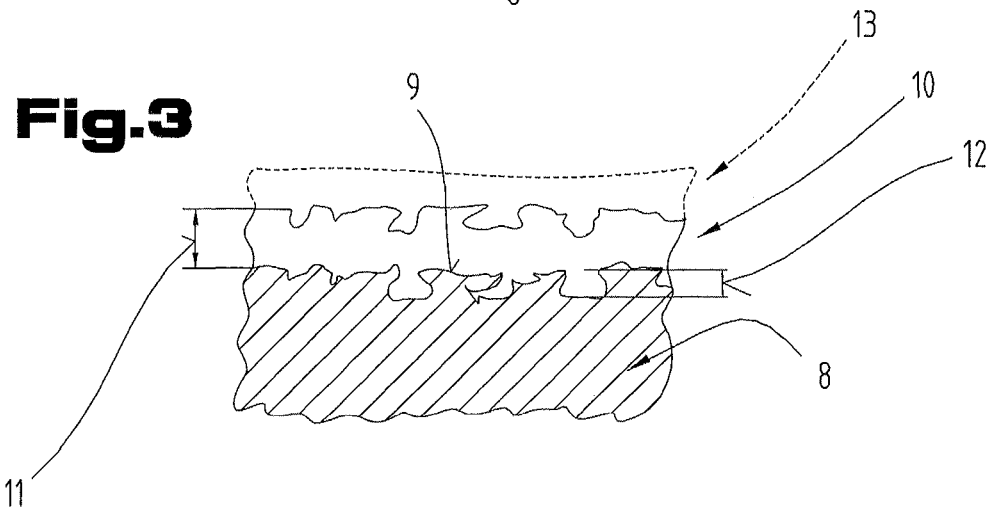
FIG. 3 shows a cut-out of a swash plate in cross-section.

By means of plasma-nitriding or plasma-carburization a nitrided layer 10 or carbonitrided layer can be formed on the surface 9 of the sintered main swashplate body 8, as shown in the Fig. Said layer 10 here preferably forms the pores of the surface 9 of the main swashplate body 8 at least approximately, as also shown in FIG. 3.

The thickness 11 of the nitrided layer 10 or carbonitrided layer can be selected from a range of 0.005 mm to 0.04 mm, in particular between 0.01 mm to 0.02 mm. In particular, the thickness 11 of the nitrided layer 10 or carbonitrided layer is greater than a maximum depth 12 of the pores on the surface 9 of the main swashplate body 8.

The nitrided layer 10 or carbonitrided layer can have a hardness of between 650 HV 0.015 and 800 HV 0.015.

It is also preferable if the nitrided layer 10 or carbonitrided layer is produced entirely as a diffusion layer. This means that nitrogen and possibly carbon are only present in a diffused form and not in the form of chemical compounds, such as e.g. iron nitrides.

According to a further embodiment variant it is possible that an additional surface layer 13 is deposited onto the nitrided or carbonitrided surface of the main swashplate body 8, as shown by dashed lines in FIG. 3.

The additional surface layer 13 can in particular consist of an anti-friction lacquer layer or a PVD layer or a DLC layer (diamond-like carbon).

The example embodiments show or describe possible embodiment variants, wherein it should be noted here that also various different combinations of the individual embodiments are possible.

Lastly, as a point of formality, it should be noted that for a better understanding of the structure of the swashplate compressor 1 the latter is not shown to scale and/or has been enlarged and/or reduced in size.

LIST OF REFERENCE NUMERALS

1 swashplate compressor
2 housing
3 piston
4 drive axle
5 swashplate
6 swashplate shoe
7 surface
8 main swashplate body
9 surface
10 layer
11 thickness
12 depth
13 surface layer

The invention claimed is:

1. A method for producing a swashplate for a swashplate compressor, wherein the swashplate comprises a main swashplate body, the method comprising:

making the main swashplate body from one or more sintering powders according to a powder-metallurgical method, wherein the main swashplate body is made from an iron-based sintering powder, wherein as the iron-based sintering powder an alloy is used which contains between 0.1 wt. % and 0.9 wt. % C, between 0 wt. % and 5.0 wt. % Ni, between 0.04 wt. % and 2 wt. % Mo, between 0.05 wt. % and 1 wt. % Mn and between 0 wt. % and 3 wt. % copper, the remainder being formed by iron, plasma-nitriding or plasma-carbonitriding for hardening the surface of the main swashplate body to produce a plasma-nitrided or plasma-carbonitrided surface layer directly on the main swashplate body, wherein the plasma-nitrided or plasma-carbonitrided surface layer at least approximately contours the pores of the surface of the main swashplate body.

2. The method as claimed in claim 1, wherein an additional surface layer is deposited onto the plasma-nitrided or plasma-carbonitrided surface layer of the main swashplate body.

3. The method as claimed in claim 2, wherein an anti-friction lacquer layer or a PVD-layer or a DLC-layer is deposited as an additional surface layer.

4. A swashplate for a swashplate compressor comprising a main swashplate body, wherein the main swashplate body is made from an iron-based sintering powder, wherein the iron-based sintering powder is made from an alloy, which contains between 0.1 wt. % and 0.9 wt. % C, between 0 wt. % and 5.0 wt. % Ni, between 0.04 wt. % and 2 wt. % Mo, between 0.05 wt. % and 1 wt. % Mn and between 0 wt. % and 3 wt. % copper, the remainder being formed by iron, a plasma-nitrided or plasma-carbonitrided surface layer produced directly on the main swashplate body by plasma-nitriding or plasma-carbonitriding the main swashplate body, wherein the plasma-nitrided or plasma-carbonitrided surface layer at least approximately contours the pores of the surface of the main swashplate body.

5. The swashplate as claimed in claim 4, wherein an additional surface layer is arranged on the plasma-nitrided or plasma-carbonitrided surface layer of the main swashplate body.

6. The swashplate as claimed in claim 5, wherein the additional surface layer is an anti-frictional lacquer layer, a PVD layer or a DLC-layer.

7. A swashplate compressor comprising the swashplate as claimed in claim 4.

* * * * *